United States Patent [19]

Axe et al.

[11] 4,264,844

[45] Apr. 28, 1981

[54] ELECTRICAL IGNITERS

[76] Inventors: Gavin C. H. Axe, 11 Winterfold Close, Southfields, London SW 19; Kenneth A. Goreham, 36 Brightling Rd., Crofton Park, London SE4 1SQ, both of England

[21] Appl. No.: 77,061

[22] Filed: Sep. 19, 1979

[30] Foreign Application Priority Data

Sep. 29, 1978 [GB] United Kingdom ..... 38717/78

[51] Int. Cl.[3] ..... H01T 13/52

[52] U.S. Cl. ..... 315/111; 313/120; 313/131 A; 313/231

[58] Field of Search ..... 313/120, 130, 131 A, 313/231; 315/111

[56] References Cited

U.S. PATENT DOCUMENTS

| | | | |
|---|---|---|---|
| 3,330,985 | 7/1967 | Johnston | 313/120 |
| 4,007,391 | 2/1977 | Baker | 313/131 A |
| 4,142,121 | 2/1979 | Carpenter | 313/131 A |

*Primary Examiner*—Eugene R. LaRoche
*Attorney, Agent, or Firm*—Pollock, Vande Sande & Priddy

[57] ABSTRACT

An electrical igniter has two electrodes separated over the bore of a semiconductive annular element. One electrode is mounted at the operative tip of the igniter and has an orifice through which the bore opens from the igniter. A capillary tube extends from a supply of liquid, such as water or a hydrocarbon fuel, and opens into the cavity formed by the bore and the orifice. Small quantities of liquid are introduced into the cavity via the tube and electrical energy is applied to the electrodes to cause discharge within the cavity. The discharge causes a plasma to be ejected through the orifice, for igniting a fuel-air mixture externally of the igniter. The discharge causes vaporization and molecular disruption of liquid present in the cavity that increases the concentration of low activation energy species within the plasma and thereby improves the efficiency of ignition.

15 Claims, 1 Drawing Figure

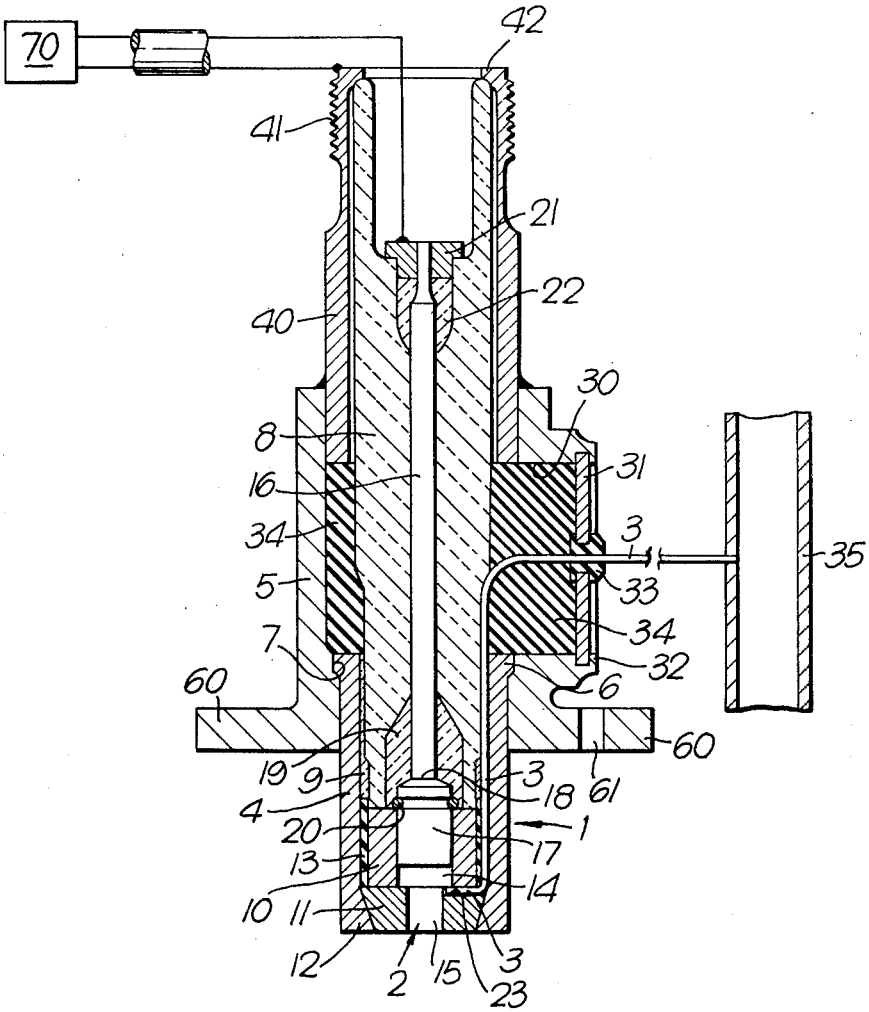
70
42
41
21
22
40
30
8
31
16
3
34
35
5
33
34
7
32
60
6
60
19
9
3
61
18
4
1
20
17
13
14
10
11
12
2
15
3
23

ELECTRICAL IGNITERS

BACKGROUND OF THE INVENTION

This invention relates to electrical igniters and to methods of electrical ignition.

The invention is particularly though not exclusively concerned with igniters of the kind for use in gas-turbine engines and with methods of igniting and maintaining combustion in gas-turbine engines.

Electrical igniters for gas-turbine engines and other applications are known (from, for example, U.S. Pat. No. 4,142,121) where two electrodes are separated from one another over a semiconductive surface within a cavity at the operative tip of the igniter.

Application of suitably high electrical energy to the electrodes causes discharge within this cavity which in turn produces a plasma that is ejected forwardly from the operative tip so as thereby to cause ignition of a mixture of vaporized fuel and air in the combustion chamber of the engine.

BRIEF SUMMARY OF THE INVENTION

It is an object of the present invention to provide an igniter that enables production of a plasma having improved ignition properties. It is another object of the present invention to provide an improved method of ignition.

According to one aspect of the present invention there is provided an electrical igniter having first and second electrodes separated from one another over a semiconductive surface, the surface being located within a cavity of the igniter that opens from the igniter at its operative tip such that discharge within the cavity causes a plasma to be ejected through the opening at the tip, wherein the igniter also includes a passageway for enabling small quantitites of liquid to be introduced into the cavity prior to discharge such that discharge within the cavity causes vaporization and molecular disruption of the liquid so as thereby to increase the concentration of low activation energy species within said plasma.

According to another aspect of the present invention there is provided a method of electrical ignition in which small quantities of liquid are introduced into a cavity of an igniter, the cavity opening from the igniter at its operative tip, and in which electrical discharge is caused over a semiconductive surface located within said cavity so as to cause a plasma to be ejected from the cavity and so as to cause vaporization and molecular disruption of said liquid, thereby increasing the concentration of low activation energy species above that which would be present without said liquid.

The semiconductive surface may be provided over the bore through an annular element. The liquid may be introduced to said cavity through a capillary tube. The liquid may, for example, be a hydrocarbon fuel or water.

The increase in the concentration of low activation energy species within the plasma gives an improved efficiency of ignition of the fuel-air mixture in the combustion chamber of the engine.

An electrical igniter for a gas-turbine engine in accordance with one aspect of the present invention and a method of ignition in accordance with the other aspect of the present invention will now be described, by way of example, with reference to the accompanying drawing.

BRIEF DESCRIPTION OF THE DRAWING

The drawing is a cross-sectional elevation through the igniter.

DETAILED DESCRIPTION

The igniter has a generally cylindrical nose portion 1 defining the operative tip of the igniter. A cavity 2 is formed within the forward tip of the nose portion and opens externally of the igniter. Small amounts of liquid are injected into the cavity 2 via a capillary feed tube 3 and, when suitably high electrical energy is applied to the igniter, discharge occurs within the cavity which produces a plasma that is ejected forwardly of the igniter.

The nose portion 1 has an outer shell 4 of stainless steel, one end of which is located within the main housing 5 of the igniter by means of an outwardly projecting lip 6 formed at the rear end of the shell. The lip 6 sits in an annular recess 7 in the main housing 5, the nose portion being secured in position by brazing. A tubular ceramic insert 8 extends coaxially within the rear end of the outer shell 4 and is sealed with the shell 4 at its forward end by means of a seal 9 of glass material. The forward end of the insert 8 abuts the rear of an annular semiconductive pellet 10 which in turn abuts the rear of a tungsten ring 11 mounted at the forward tip of the nose portion 1. The tungsten ring 11 has a tapering outer surface which engages an inwardly-flared portion 12 formed at the forward end of the shell 4. The semiconductive pellet 10 is insulated from the outer shell 4 by an electrically insulative sleeve 13 which may, for example, be of a filamic material (that is a material formed from a reconstituted mica flake in a silicone resin matrix). The sleeve 13 surrounds the pellet 10 and the forward end of the ceramic insert 8.

The cavity 2 at the forward tip of the nose portion 1 is defined by a bore 14 through the semiconductive pellet 10, together with an orifice 15 through the tungsten ring 11. The forward end of an inner electrode 16 extends within the rear part of the bore 14 through the pellet 10. This forward end of the inner electrode 16 is formed by a tungsten tip 17 that is welded at its rear end 18 to the remainder of the electrode which is of a nickel, cobalt, iron alloy such as, for example, is sold under the name of Nilo K. The inner electrode 16 extends coaxially through the ceramic insert 8 and is sealed at its forward end by means of a seal 19 of glass material formed within the forward end of the insert. A metal ring 20 is sprung into a groove around the circumference of the tip 17 such as to engage the rear end of the pellet 10 and so as thereby to prevent the tip 17 dropping downwards from the remainder of the inner electrode 16 in the event of failure of the welded joint at its rear end 18.

The rear end of the inner electrode 16 is welded to a contact bush 21 which is for use in establishing electrical contact with the electrode and which is supported in the rear end of the ceramic insert 8. The inner electrode 16 is sealed at its rear end by means of a seal 22 of glass material formed within the rear end of the insert 8.

The feed tube 3 is of metal and has a forward end which lies in a radial groove 23 formed in the rear flat surface of the ring 11 and which opens into the cavity 2. The feed tube 3 extends rearwardly of the igniter between the ceramic insert 8 and the outer shell 4. The tube 3 is bent at right angles about midway along the length of the igniter, extending radially out of the igniter through a side-opening 30. The opening 30 is formed in the main housing 5 and is closed by a metal plate 31 that is held in position by a rolled-over lip 32 engaging its circumference. The feed tube 3 is supported by a silicone rubber grommet 33 which is secured in a central aperture in the plate 31 and which also serves electrically to insulate the feed tube from the plate and the igniter housing 5. The housing 5 also contains an insulative filling 34 of silicone rubber which further supports and insulates the feed tube 3.

The feed tube 3 extends away from the igniter and is joined at its rear end to a supply pipe 35 carrying liquid hydrocarbon fuel to the engine. Electrical insulation can be provided at some position along the length of the tube 3, or where the tube is joined to the pipe 35, such that the supply pipe is electrically isolated from the igniter.

The igniter also has a rear outer sleeve 40 through which electrical connection to the inner electrode 16 is made. The sleeve 40 is of stainless steel and is brazed within the rear end of the housing 5, the sleeve being formed with a screw-threaded portion 41 on its outer surface, that is for use in securing an electrical connector (not shown) to the igniter. The sleeve 40 is rolled over at its rear end to form a lip 42 that engages the rear end of the ceramic insert 8.

The igniter is arranged for mounting on an engine housing with the nose portion 1 projecting into (or inwardly towards) the engine combustion chamber. To this end, the igniter housing 5 is provided with a flange 60 which extends radially outwards of the nose portion 1 and which is arranged to abut the outer surface of the engine housing. The igniter is securely bolted in position on the engine housing by means of bolt holes 61 (only one of which is shown) provided in the flange 60; a gasket may be interposed between the flange and the housing so as to form a gas-tight seal.

In operation, fuel passing along the supply pipe 35 is forced to the forward end of the feed tube 3 where it drops into the cavity 2. External electrical connection to the inner electrode 16 and to the outer electrode, which is constituted by the tungsten ring 11, is made via an electrical connector (not shown) engaging the sleeve 40 and the contact bush 21. A supply unit 70 provides suitable high electrical energy which is applied via the connector such that discharge occurs between the ring 11 and the tip 17 over the semiconductive surface formed by the bore 14 of the pellet 10. This high energy (surface) discharge causes vaporization of the liquid fuel within the cavity 2 and produces a plasma by breaking down this vaporized fuel into its low activation energy molecular species. The plasma is ejected through the orifice 15 into the engine combustion chamber by the action of the expanding gases. The introduction of liquid into the cavity 2 has, therefore, two main effects, the first being to increase the concentration of low activation energy species in the plasma (above that which would occur without the introduction of liquid), and the second being to aid projection of the plasma from the igniter by the action of the vaporization of the liquid and expansion of the gases produced. The addition of insulative liquid to the cavity also has the effect of increasing the impedance of the gap between the two electrodes 11 and 17, and, in this way, more of the energy of the supply unit 70 is transferred to the plasma.

The diameter of the orifice 15 is about 3 mm (the diameter of the bore 14 of the pellet 10 being about 3.81 mm), the thickness of the ring 11 is about 1.73 mm and the gap between the rear of the ring 11 and the tip 17 of the inner electrode is about 1.27 mm. This gives the cavity 2 an overall volume of about 26.7 microliters. The amount of liquid supplied to the cavity 2 is only relatively small, being about 0.5 to 1.0 microliters, that is, about 1.9% to 3.7% of the cavity volume. The amount of liquid supplied to the cavity will depend upon the length, and internal diameter of the feed tube 3 and the fluid pressure in the supply pipe 35. The size and shape of the cavity 2 and the orifice 15 determine the manner in which the plasma is ejected into the engine combustion chamber. With a small orifice 15, for example, the plasma is ejected a greater distance from the igniter. This has the advantage that the igniter can be located at a greater distance away from the combustion zone of the engine, thereby avoiding sujecting the igniter to the high temperatures experienced in the combustion zone and also reducing the risk of contamination with combustion products.

Whilst there are advantages in providing an igniter with a small orifice, there can also be disadvantages, in that, as the plasma is blown through the orifice 15 there is a tendency for the low activation evergy species to be 'quenched' on the wall of the orifice (that is, to react with the wall to produce stable species which play no part in the combustion process) thereby leading to a reduction in the concentration of these species and a consequent reduction in ignition efficiency. The amount of quenching will increase as the diameter or cross-sectional area of the orifice 15 decreases since the amount of plasma coming into contact with the orifice wall will be greater for orifices of smaller area. The size of the cavity 2 and its orifice 15 should therefore be selected such that the plasma flame is ejected to a region where ignition will occur most efficiently, taking into account the size and geometry of the combustion chamber and the location of the igniter, whilst also taking into account the fact that reducing the size of the orifice reduces the concentration of low activity energy species in the plasma. It will be appreciated that the bore 14 and the orifice 15 need not be of circular cross-section.

It is not essential that the liquid injected into the cavity 2 be a flammable fuel, it could, for example, be liquid water. The use of surface-discharge type ignition enables sufficient energy to be supplied for vaporizing the water and breaking it down into low activation energy species.

Alternative arrangements for supplying liquid to the igniter cavity 2 are also envisaged. The feed tube 3 could, for example, extend through the inner electrode 16.

The semiconductive surface need not necessarily be provided on the bore of an annular pellet but could, for example, be provided on a surface of any other shape extending between two electrodes within a cavity.

We claim:

1. Electrical ignition apparatus including:

an electrical igniter having first and second electrodes, a semi-conductor surface located within a cavity of said igniter that opens from the igniter at its operative tip such that discharge within the cavity between said first and second electrodes causes a plasma to be ejected through the opening at said tip, said first and second electrodes being separated one from another in said cavity over said semi-conductive surface, a passageway opening into said cavity, and means for supplying a liquid through said passageway into said cavity prior to discharge in a quantity substantially less than the volume of said cavity such that discharge within the cavity causes vaporization and molecular disruption of the liquid so as to increase thereby the concentration of low activation energy species within said plasma.

2. Electrical ignition apparatus according to claim 1, wherein the semiconductive surface is provided over a bore through an annular member, and wherein said cavity is provided, at least in part, by said bore.

3. Electrical igniton apparatus according to claim 2, wherein said annular member is of a semiconductive material.

4. Electrical igniter apparatus according to claim 1, wherein one of said first and second electrodes is located at the tip of the igniter, and wherein said one electrode has an orifice through which said plasma is ejected.

5. Electrical ignition apparatus according to claim 4, wherein said semiconductive surface is provided over a bore through an annular member, and wherein the said one electrode is of ring-shpe and is located at the tip of the igniter so that the orifice of said one electrode thereby forms a part of said cavity.

6. Electrical ignition apparatus according to claim 5, wherein the cross-sectional area of said orifice is less than the cross-sectional area of said bore.

7. Electrical ignition apparatus according to claim 1, wherein said passageway is provided by a capillary tube, and wherein said tube extends to and opens into said cavity.

8. Electrical ignition apparatus according to claim 1, wherein the volume of liquid introduced into said cavity prior to discharge is less than 5% of the volume of said cavity.

9. Electrical ignition apparatus according to any one of the preceding claims, wherein said liquid is water.

10. Electrical ignition apparatus according to any one of claim 1, claims 2 to 8, wherein said liquid is a hydrocarbon fuel.

11. Electrical ignition apparatus comprising: an igniter having an annular member having a bore with a semiconductive surface; a first electrode mounted at one end of said bore; a second electrode mounted at the other end of said bore, said second electrode having an orifice through which said bore opens externally of said igniter, said bore and orifice together defining a cavity of said igniter; liquid supply means; a liquid-supply tube mounted with one end opening into said cavity and with its other end communicating with said liquid supply means so as thereby to enable quantities of liquid substantially less than the volume of the cavity to be introduced into said cavity, such that upon discharge between said first and second electrodes over said semiconductive surface a plasma is ejected from the igniter through said orifice and such that said discharge causes vaporization and molecular disruption of liquid present in said cavity thereby increasing the concentration of low activation energy species within said plasma.

12. A method of electrical ignition of the kind in which electrical discharge is caused over a semiconductive surface located within a cavity of an igniter so as to cause a plasma to be ejected from the cavity through an opening at the tip of the igniter, for use in ignition of a fuel-air mixture externally of the igniter, the improvement wherein quantities of liquid substantially less than the volume of the cavity are introduced into said cavity prior to discharge such that upon discharge vaporization and molecular disruption of the liquid occurs thereby creating a plasma with increased concentration of low activation energy species.

13. A method of electrical igniton according to claim 12, wherein the volume of liquid introduced prior to discharge is less than 5% of the volume of said cavity.

14. A method of electrical ignition according to claim 12 or 13, wherein said liquid is water.

15. A method of electrical ignition according to claim 12 or 13, wherein said liquid is a hydrocarbon fuel.

* * * * *